United States Patent [19]

Stursberg

[11] Patent Number: 4,922,744

[45] Date of Patent: May 8, 1990

[54] U-SHAPED PUNCH OR STAMPER WITH ANTI-BENDING MEMBER

[75] Inventor: Bernd Stursberg, Ennepetal, Fed. Rep. of Germany

[73] Assignee: Carl Ullrich Peddinghaus, Wuppertal-Barmen, Fed. Rep. of Germany

[21] Appl. No.: 316,754

[22] Filed: Feb. 28, 1989

[30] Foreign Application Priority Data

Mar. 19, 1988 [DE] Fed. Rep. of Germany ..... 3809327

[51] Int. Cl.[5] ..... B21D 37/00

[52] U.S. Cl. ..... 72/455; 100/214; 100/231; 83/859

[58] Field of Search ..... 72/319, 455; 100/214, 100/231; 83/859

[56] References Cited

U.S. PATENT DOCUMENTS

| | | | |
|---|---|---|---|
| 2,602,508 | 7/1952 | Patrick | 100/231 |
| 3,561,252 | 2/1971 | Norton et al. | 72/455 |
| 3,662,640 | 5/1972 | Wrona | 100/231 |
| 3,884,142 | 5/1975 | Jonsson | 72/455 |
| 4,018,150 | 4/1977 | Shiokawa | 100/231 |
| 4,033,216 | 4/1977 | Brolund et al. | 83/413 |
| 4,389,869 | 6/1983 | Van Cleave | 72/319 |
| 4,434,646 | 3/1984 | Maeda et al. | 72/455 |

FOREIGN PATENT DOCUMENTS

| | | | |
|---|---|---|---|
| 2442433 | 9/1974 | Fed. Rep. of Germany | 100/231 |
| 2926047 | 6/1979 | Fed. Rep. of Germany | 100/231 |
| 3137799 | 4/1983 | Fed. Rep. of Germany | 100/231 |
| 3208018 | 7/1983 | Fed. Rep. of Germany | 100/231 |
| 0148323 | 5/1981 | German Democratic Rep. | 100/231 |
| 1222573 | 4/1986 | U.S.S.R. | 100/231 |

*Primary Examiner*—David Jones
*Attorney, Agent, or Firm*—Herbert Dubno

[57] ABSTRACT

The punch machine comprises a U-shaped member having an upper leg, a lower leg and a crosspiece to thereby form a U-shaped work space open on the front side of the punch machine but closed on the rear side by the crosspiece between the upper leg and the lower leg, a punch piston-cylinder unit with a punch tool mounted in the upper leg and a die-bearing member and/or a workpiece receiving member mounted in the lower leg. At least the upper leg experiences a bending moment and a resultant elastic deformation caused by the punching force occurring during the punching operation. To reduce the deformation, a tie bar connects both the lower and the upper legs located horizontally between the crosspiece and the punch piston-cylinder unit. This tie bar passes through or by the work space. It may be moved horizontally according to the punching force to reduce the elastic deformation. Also a process is described for operating the punch machine which keeps the bending moment constant.

2 Claims, 1 Drawing Sheet

U-SHAPED PUNCH OR STAMPER WITH ANTI-BENDING MEMBER

FIELD OF THE INVENTION

Our present invention relates to a punch or stamper and, more particularly, to a punch or stamping machine with a U-shaped frame.

BACKGROUND OF THE INVENTION

U.S. Pat. No. 4,033,216 describes a punch having a front side and a rear side comprising a U-shaped machine frame with an upper leg, a lower leg and a crosspiece, which forms a U-shaped work space open on the front side of the punch machine but closed on the rear side by the crosspiece between the upper and the lower leg.

A punch piston-cylinder unit with a punch tool is mounted in the upper leg and a die-bearing member and/or a workpiece receiving member are mounted in the lower leg.

At least the upper leg experiences a bending moment due to punching or stamping forces occurring during a punching operation. Hence, an elastic deformation of that leg occurs.

In the punch machine of U.S. Pat. No. 4,033,216 according to different punching forces occurring in working different weight workpieces, the leg of the machine frame experiences different bending moments. The machine frame and the leg are designed so that the maximum occurring bending moment can be withstood by the frame and is not particularly troublesome. However that makes the machine frame heavy. Furthermore any deformation of the frame occurring causes a deviation of the punch tool axis and the axis of the die-bearing member from their initial axial parallel relationship.

To limit the bending moment occurring in a punch machine of the described basic structure, a strap is installed at the front end of a leg, just in front of the punch piston-cylinder unit, which is pivotable about a horizontal axis and in a pivoted-in state connects the front of the upper leg and the lower U-leg. During the punching process the strap is under tension. This particular design from the connecting member or strap is troublesome because in the pivoted-in state the work space is no longer easily accessible and open.

In DE-OS No. 2926097 a different method is used to limit the bending moment in a punch machine. Here a second machine frame is movable in a horizontal direction in the first machine frame, which carries the punch piston-cylinder unit with the punch tool and the die-bearing member. That is comparatively expensive. Since the deformation of the legs can destroy the parallel relationship between the punch tool axis and the die-bearing member axis, as described in DE-OS No. 24 42 433 the punch piston-cylinder unit with the punch tool is supported pivotally on the upper leg so that during the punch process the parallel relationship between the punch tool and the opposing die-bearing member is maintained.

OBJECT OF THE INVENTION

It is an object of the present invention to provide an improved punch machine as described above in which the bending moment which the leg takes can be kept constant even when a variety of different punching forces are applied to workpieces of different weight and type.

Another object is to provide an improved punch or stamper having a U-shaped frame but in which the abovementioned drawbacks are eliminated.

SUMMARY OF THE INVENTION

According to our invention, both the lower and the upper legs are connected by a tie bar horizontally positioned between the crosspiece and the punch piston-cylinder unit, which passes through or by the work space, and the tie bar is movable horizontally according to the punching force for reduction of elastic deformation.

The detailed methods by which the above is accomplished can vary. The tie bar can be a simple connecting member or twin connecting members. Generally the tie bar is guided or moved on guide rails on the leg. In this connection according to a feature of the invention two steel plate-side walls are provided on the legs.

The guide rails are attached on the inside on the steel plate-side walls and the flanges of the tie bar which is T-shaped in cross section are guided on the guide rails secured in that way.

The tie bar can be adjusted by hand in a small punch machine. However it is also possible to move the tie bar by a positioning drive connected therewith.

In the punch machine according to our invention, by moving the tie bar the elastic deformation can be adjusted due to an applied predetermined punching force. Particularly it is possible to adjust or set the tie bar a distance D from the axis of the punch tool so that the bending moment of the punching force F and this distance D is kept constant (i.e. $F \times D = \text{constant}$) no matter what the magnitude of the bending force F may be.

Thus, the machine frame of the punch machine can be so designed that a constant control of the deformation of the leg can be ensured. It can be guaranteed that the parallel relationship between the punch tool axis and the axis of the die-bearing member is not disturbed or destroyed.

BRIEF DESCRIPTION OF THE DRAWING

The above and other objects, features and advantages of our invention will become more readily apparent from the following description, reference being made to the accompanying highly diagrammatic drawing in which.

SPECIFIC DESCRIPTION

Figure 1:
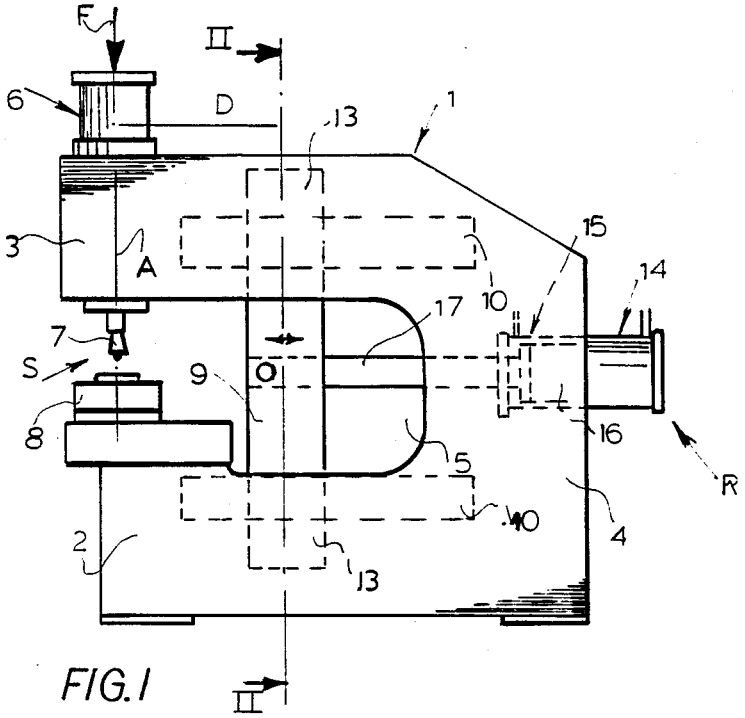
FIG. 1 is a side elevational view of a punch machine according to our invention.

The punch machine shown in the drawing has a machine frame which is U-shaped when observed from the side as in FIG. 1. This provides a work space 5 open on the front side S of the punch machine but closed on the rear side R by a crosspiece 4 between the lower leg 2 and the upper leg 3.

A punch piston-cylinder unit 6 with the punch tool 7 is mounted in the upper leg 3. A die-bearing member 8 and/or a workpiece receiving member 8 is located in the lower leg 2. In this punch machine at least the upper leg 3 experiences a bending moment and a resultant elastic deformation due to the punching force occurring during punch operation.

Figure 2:
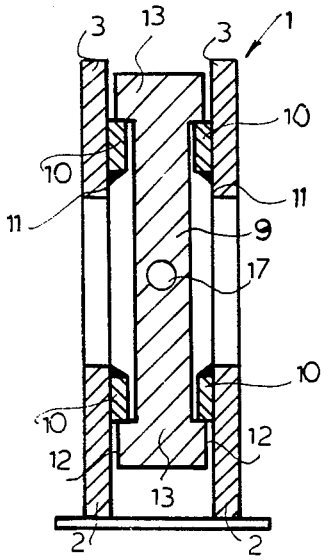
FIG. 2 is a cross sectional view taken along the section line II—II of FIG. 1.

From a comparison of FIGS. 1 and 2 one sees that both legs 2, 3 are connected by a tie bar 9. The apparatus is designed so that the tie bar 9 passes through or past the work space 6 as seen in the side elevational view.

The tie bar 9 is movable in the horizontal direction according to the punching force to reduce the elastic deformation. For this purpose guide rails 10 are provided on the legs 2, 3.

From FIG. 2 it can be seen that the legs 2, 3 have two steel plate-side walls 11, 12 in this example. The guide rails 10 are located inside on the steel plate-side walls 11, 12. They guide the flanges 13 of the tie bar 9 which has an I-shaped cross section.

The tie bar is connected to a positioning drive 14 and is movable by it. In this embodiment the positioning drive 14 has a piston-cylinder unit 15 with a cylinder is attached to the crosspiece 4 and the piston rod 17 is fixed to the tie bar 9.

The tie bar 9 can be moved to various distances D from the axis A of the punch tool 7 so that the bending moment ($F \times D$) in the terms of the punching force F and the distance D of the bar from the punching axis stays constant, independently of an increasing punching force F.

I claim:

1. In a punch machine having a front side and a rear side comprising a U-shaped member with an upper leg, a lower leg and a crosspiece to thereby form a U-shaped work space open on said front side of said punch machine but closed on said rear side by said crosspiece between said upper leg and said lower leg, in which a punch piston-cylinder unit with a punch tool is mounted in said upper leg and a die-bearing member and/or a workpiece receiving member are mounted in said lower leg, in which at least said upper leg experiences a bending moment and a resultant elastic deformation due to a punching force occurring during a punching operation, the improvement wherein both said lower and said upper legs are connected by a tie bar positioned between said crosspiece and said punch piston-cylinder unit, said unit passes through or by said work space, said tie bar is movable horizontally according to said punching force to reduce said elastic deformation, said tie bar is guided on a plurality of guide rails mounted on said upper and lower legs, said tie bar has two flanges and an I-shaped cross section, said upper and lower legs have two steel plate-side walls, said guide rails are mounted inside of said steel plate-side walls and guide said tie bar, and said flanges engage on said guide rails.

2. The improvement defined in claim 1 wherein said tie bar is connected to a positioning drive and is movable thereby.

* * * * *